US007337880B2

(12) United States Patent
Sittler

(10) Patent No.: US 7,337,880 B2
(45) Date of Patent: Mar. 4, 2008

(54) ELEVATOR CAR WITH LOWERABLE ROOF

(75) Inventor: Denis Sittler, Illzach (FR)

(73) Assignee: Inventio AG, Hergiswill NW (CH)

( * ) Notice: Subject to any disclaimer, the term of this patent is extended or adjusted under 35 U.S.C. 154(b) by 0 days.

(21) Appl. No.: 11/421,134

(22) Filed: May 31, 2006

(65) Prior Publication Data

US 2006/0289244 A1 Dec. 28, 2006

(30) Foreign Application Priority Data

Jun. 3, 2005 (EP) ..... 05104869

(51) Int. Cl.
*B66B 13/28* (2006.01)
*B66B 1/34* (2006.01)

(52) U.S. Cl. ..... 187/401; 391/254

(58) Field of Classification Search ..... 187/401, 187/391, 254

See application file for complete search history.

(56) References Cited

U.S. PATENT DOCUMENTS 3,704,799 A * 12/1972 Morris, Jr. ..... 414/444
6,202,801 B1 * 3/2001 Muller et al. ..... 187/401
6,880,678 B1 * 4/2005 Schneider et al. ..... 187/314
2004/0206580 A1 * 10/2004 Ishii et al. ..... 187/264

FOREIGN PATENT DOCUMENTS

| | | |
|---|---|---|
| DE | 101 04 351 | 8/2002 |
| EP | 1 026 117 | 8/2000 |
| JP | 09263372 | 10/1997 |

* cited by examiner

*Primary Examiner*—Patrick Mackey
*Assistant Examiner*—Terrell Matthews
(74) *Attorney, Agent, or Firm*—Fraser Clemens Martin & Miller LLC; William J. Clemens

(57) ABSTRACT

An elevator car has a lowerable car roof portion serving in the lowered state as a maintenance platform. The lowerable car roof portion is stabilized in the lowered position against movements in a horizontal plane by at least one mechanical device engaging the car roof portion and inner walls of the car.

8 Claims, 4 Drawing Sheets

ELEVATOR CAR WITH LOWERABLE ROOF

BACKGROUND OF THE INVENTION

The present invention relates to an elevator car with a car roof lowerable into the interior space of the elevator car.

In conventional elevator installations there is usually present above the end, which is determined by the uppermost position of the elevator car, of an elevator shaft an additional annex in which the drive system and other components of the elevator are accommodated. Reduced dimensions of the drive systems and changed elevator constructional regulations currently make it possible to offer so-termed machine-room-free elevators in which the elevator components are mounted in the elevator shaft and no additional annex (machine room) is present. Checks and maintenance operations of the elevator components mounted in the elevator shaft are usually carried out in such an elevator installation by a service engineer standing on the roof of the elevator car. The elevator car together with the service engineer is for this purpose moved between the different maintenance positions. By regulation a sufficient safety spacing between the car roof and the upper termination of the elevator shaft must be ensured for the safety of the service engineer.

Japanese patent document JP 09263372 shows a method in which the roof of the elevator car is, for service operations, lowered into the interior space of the elevator car. The service engineer can thereby stand on the lowered car roof without risk even at the uppermost floor.

During service operations the lowered car roof hangs in the interior space of the elevator car by cables. Movements of the lowered car roof in the horizontal plane occur due to the operations and the movements connected therewith of the service engineer. These movements of the car roof in the interior space of the elevator car can lead to damage of the elevator car. Moreover, it is important for performance of the operations that the service engineer has available a stable, non-fluctuating work surface.

SUMMARY OF THE INVENTION

It is an object of the present invention to create an elevator car which does not have the aforesaid disadvantages.

In the case of the present invention the object is fulfilled in that with an elevator car, which is used in an elevator shaft without an machine room and has a lowerable car roof, the lowered car roof is stabilized against movements in the horizontal plane by means of a device, i.e. relative movements between the car roof and the car walls are prevented by a device.

An elevator car according to the present invention has the advantage that movements of a service engineer standing on the lowered car roof and carrying out service operations do not lead to damage of the interior space of the elevator car by the lowered and moving car roof and that the service engineer has available a stable work platform.

Advantageously the device by which the lowered elevator car roof is stabilized is a mechanical stabilizing device arranged between the lowered car roof and a car inner wall. The mechanical stabilizing device has the advantage that the lowered elevator car roof can come into movement relative to the elevator car only to a very limited extent. Impact of the lowered car roof against the car inner wall can thus be prevented. Depending on the respective kind and character of the mechanical device for stabilization of the car roof the device can be individually adapted to spacings of different size between car roof and car inner wall.

According to a preferred embodiment of the present invention the device comprises a toggle lever clamping device, wherein the device is fastened to the lowerable car roof and can be brought with the help of the manually actuated toggle lever clamping device into a state in which a movable end of the device presses against a car inner wall so that the car roof is clamped relative to the elevator car. The clamping movement can be rapidly performed by hand with the toggle lever clamping device, wherein the requisite clamping force is produced by a small actuating force and the clamping force is maintained until desired release of the clamping device.

Advantageously the device comprises a spring element so influencing the action of the toggle lever clamping device that a permissible clamping force between the movable end of the device and the car inner wall is not exceeded.

Advantageously the device is coated or provided on a side thereof facing the car inner wall with a soft non-scratching coating. This has the advantage that on lowering and clamping of the device and in the case of slight movements of the car roof no scratching or other damage of the inner walls of the elevator car—for example of a decorative coating of a car inner wall—arises.

Advantageously the device has at one end a fastening means by which the device can be fastened to the lowerable car roof. This has the advantage that the device can be fixedly connected with the lowerable car roof. A horizontal stabilization by means of the mechanical device is achieved in this case in that a part of the mechanical device is shifted or displaced from the lowered car roof out in the direction of a car inner wall of the elevator car or in that the length of the mechanical device is varied in such a manner that a part of the drive interacts with car inner wall.

Expediently the device is adjustable in its length. This has the advantage that the device can be used in different types of elevator. The length of the device can be changed, for example by means of an adjusting thread, in correspondence with the differences between the dimensions of the lowerable car roof and the corresponding car wall spacings.

According to another embodiment the device by which the lowered car roof is stabilized can also be a cushion which is fixed or arranged between the lowered car roof and a car inner wall, wherein the mechanical stabilization is produced by selective volume enlargement of the cushion. It is achieved by such a cushion that the lowered car roof can come into motion relative to the elevator car only to a very limited extent. Movements of the car roof relative to the elevator car can be gently damped by a cushion. The filling material and the shape and the size of the cushion can then influence the damping characteristics. A cushion can similarly be individually adapted to the spacing, which is of different size depending on the respective elevator type, between car roof and car inner wall.

In a further embodiment of the present invention the device comprises at least one pneumatic cylinder arranged between the lowered car roof and a car inner wall, wherein the mechanical stabilization of the lowerable car roof is producible by outward movement of a piston rod of the pneumatic cylinder. Substantially the same advantages as with a cushion can be achieved by such a pneumatic cylinder, wherein, however, mounting and fixing of the pneumatic cylinder is simpler than mounting and fixing of cushions.

Advantageously the cushion or the pneumatic cylinder is fillable by means of a pump with a medium so as to produce the stabilization of the lowerable car roof. A hand pump or also a pump driven by electric motor can be used.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
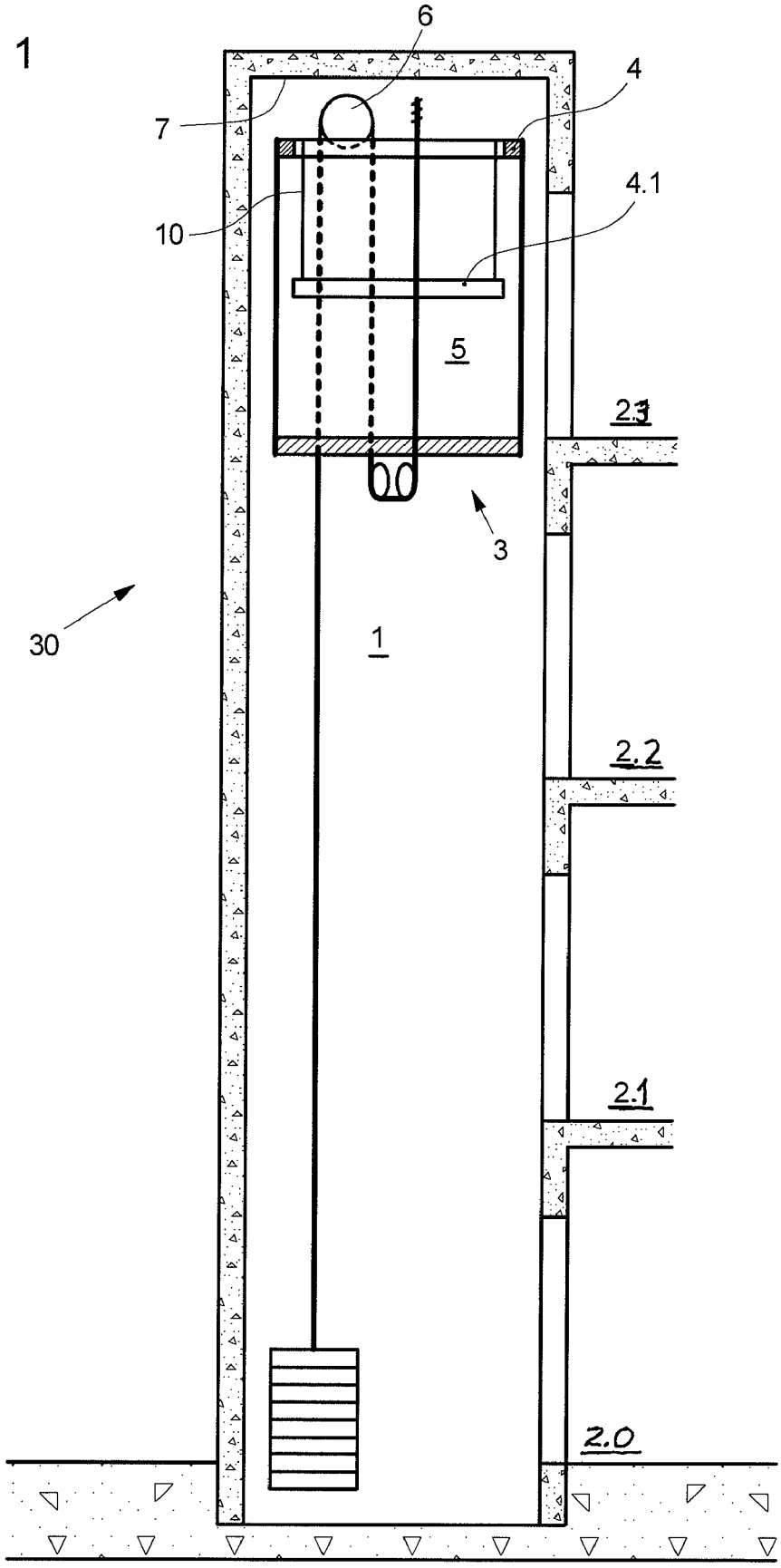
FIG. 1 is a schematic elevation view an elevator car in an elevator shaft without a machine room, the elevator car having a lowerable car roof in accordance with the present invention.

FIG. 1 shows an elevator installation 30 which is arranged in or at any building and comprises an elevator shaft 1 with an elevator car 3. This can be any elevator installation 30 without a machine room, in which the elevator car 3 driven by a drive system 6 transports passengers or goods in the elevator shaft 1 between floors 2.0, 2.1, 2.2, 2.3 of the building. The elevator shaft 1 is usually separated from the floors by doors (not shown).

As the elevator shaft 1 without a machine room there is denoted an elevator shaft which does not have available a typical space, which is present additionally to the elevator shaft, for the drive motor. The drive and/or the control of the elevator is or are usually accommodated in this so-termed machine room. Through optimization of the size and output of elevator drive systems the space requirement of the corresponding systems has been continuously reduced. It would be possible through changes in elevator regulations to construct elevator installations which do not require a machine room. This development would make it possible for building clients and architects, particularly in the case of houses with flat roofs, to omit the superimposed machine room and thus save costs and achieve more agreeable aesthetics.

The lack of space above the highest building floor 2.3 served by the elevator car 3 leads to conflicts with safety specifications. These require, in the case of service journeys of a service engineer 8 (FIG. 2A) on the car roof, a safety spacing between a car roof 4 and an upper end 7 of the elevator shaft 1.

Installation and maintenance of the elevator installation 30 are tasks of the service engineer 8. The checks then required of elevator components installed along the elevator shaft 1 can require journeys on the roof 4 of the elevator car 3. Moreover, many elements of the elevator installation 30 are accessible for the service engineer 8 only from the roof 4 of the elevator car 3. Journeys on the roof 4 of the elevator car 3 are, however, connected with risks for the service engineer 8. The engineer 8 can be placed at risk, inter alia, when traveling to the highest floor 2.3 served by the elevator car 3 by too small a spacing of the car roof 4 from the upper end 7 of the elevator shaft 1.

In order to avoid such a risk there is provided, as mentioned in the introduction above, the elevator car 3 with a lowerable car roof portion 4.1 serving as a maintenance platform.

Figure 2A:
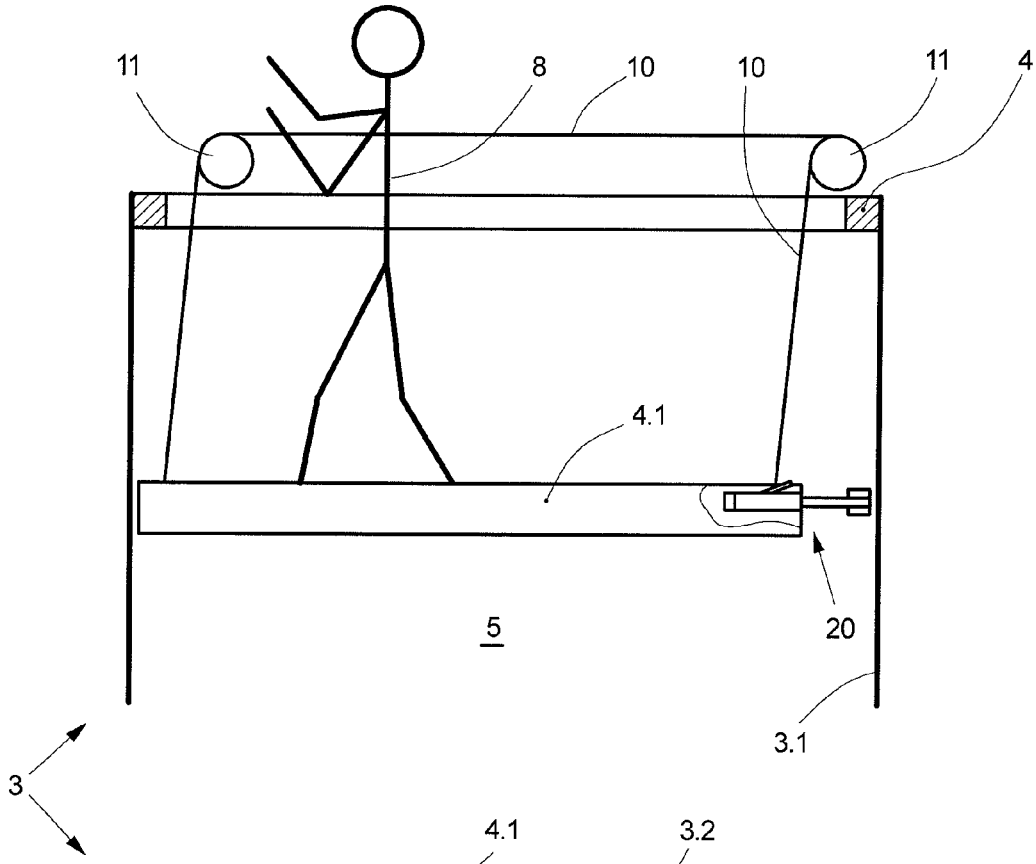
FIG. 2A is an enlarged schematic elevation view and FIG. 2B is an enlarged schematic plan view of the car roof shown in FIG. 1 with a device for mechanical stabilization against movements of the lowered car roof in a horizontal plane.
Figure 2B:
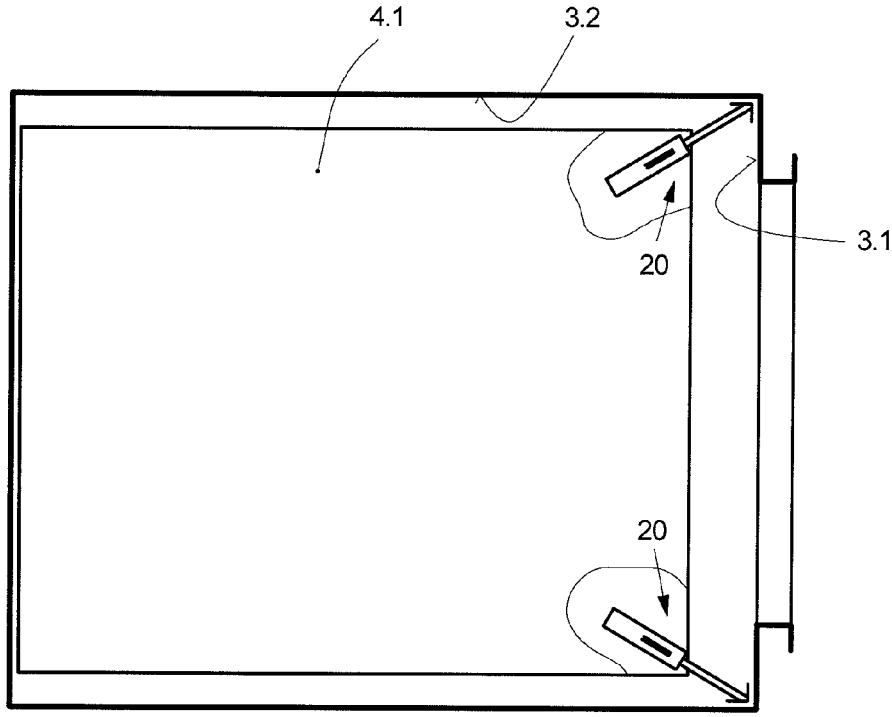

FIGS. 2A and 2B show the elevator car 3 with the lowerable car roof portion 4.1, wherein the latter is, in accordance with the present invention, stabilized by a pair of devices 20 so as to prevent horizontal movements of the car roof portion 4.1. Through the use of such a stabilized car roof portion 4.1 the risk of accident during maintenance operations can be reduced and/or it is possible to protect inner walls 3.1 of the elevator car 3 against damage by the lowered car roof portion. The portion 4.1 of the car roof 4 is lowered at means, for example at cables 10, into an interior space 5 of the elevator car 3. The means at which the car roof portion 4.1 hangs must be able to bear at least the weights of the car roof portion 4.1, at least one of the service engineer 8 and additionally tools present on the car roof portion 4.1. The means employed is accordingly advantageously a sufficiently strong steel cable 10 driven or guided by way of rollers 11. The rollers 11 are in that case advantageously, but not necessarily, mounted on the non-lowerable part of the car roof 4.

The lowerable car roof portion 4.1 can, according to the respective need, be lowered to a different extent and is then locked at a specific height in the interior space 5 of the elevator car.

If not stabilized, movements of the lowered car roof portion 4.1 in a horizontal plane can arise due to walking on the lowered car roof portion 4.1 and due to movements of the service engineer 8 carrying out operations on the lowered car roof portion 4.1. Depending on the respective form of the means at which the lowered car roof portion 4.1 hangs these movements are prevented only poorly or even not at all.

In order to avoid impact of the lowered car roof portion 4.1 against the car walls, such as the car wall 3.1 and a car wall 3.2 shown in FIG. 2B, of the elevator car 3 the lowered elevator car roof portion 4.1 is stabilized by the devices 20 relative to the car walls 3.1, 3.2 as is shown in FIGS. 2A and 2B.

Figure 3:
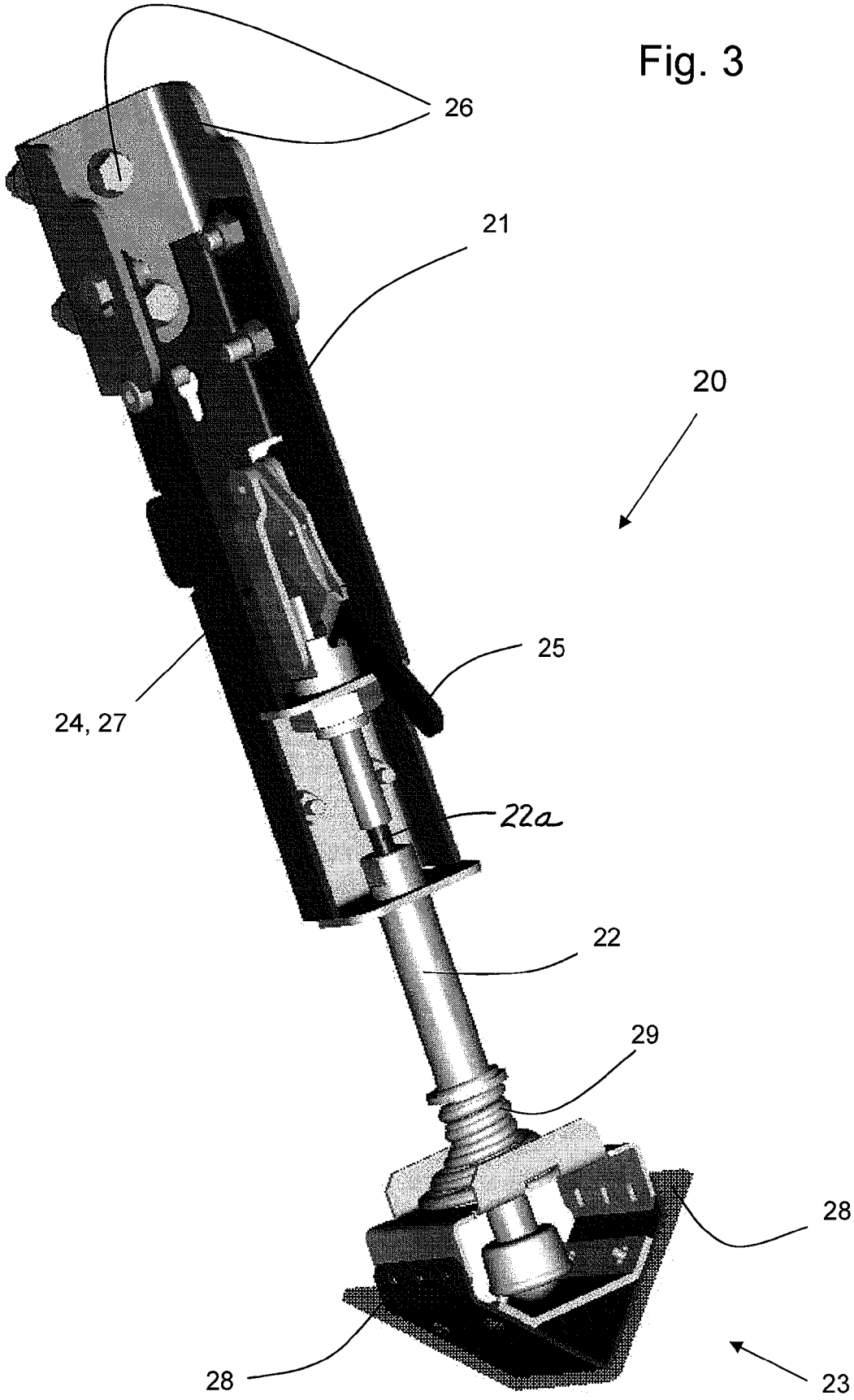
FIG. 3 is a perspective view of the device for mechanical stabilization shown in FIGS. 2A and 2B.

FIG. 3 shows details of the mechanical device 20 according to the present invention which is suitable for stabilizing the lowered car roof portion 4.1 relative to the car walls 3.1, 3.2 of the elevator car 3.

The device comprises a frame 21, a rod 22 guided in the frame 21 to be movable in a longitudinal direction, a pressure member 23 which is fixed to one end of the rod 22 and which forms the movable end of the device 20, and a toggle lever system 24 with a handle 25, which together form a toggle lever clamping device 27 at an opposite end of the rod 22. The rod 22 and the pressure member 23 can be pressed against the car walls 3.1, 3.2 of the elevator car 3 and locked in the pressed position by the toggle lever clamping device 27. The entire device 20 is fixed to the lowerable car roof portion 4.1 by a fastening means 26 at an end of the frame 21 opposite the rod 22.

A soft non-scratching coating 28 is applied to the side of the pressure member 23 facing the car walls 3.1, 3.2 of the elevator car 3. This coating 28 consists of, for example, rubber, a soft plastics material or felt. The coating 28 has to be suitable for absorbing forces, which arise due to tightening of the mechanical device 20 between the lowered car roof portion 4.1 and the car walls 3.1, 3.2 of the elevator car 3, and for distributing them as uniformly as possible over a large area so as to avoid damage of the car walls.

In addition, a spring element 29 can be incorporated in the mechanical device 20 or provided at the device 20 for avoidance of impermissibly large clamping forces acting on the elevator car 3. The spring element 29 is connected between the rod 22 and the pressure member 23. The spring element 29 can, in addition, provide compensation in a resilient manner for angular deviations and lateral offsets between the pressure member 23 and a car corner formed by the two side walls 3.1, 3.2.

In order that the mechanical device 20 can be used in as many possible elevator car types with spacings of different size between the lowerable car roof portions 4.1 and the car walls 3.1, 3.2 it is constructed to be adjustable in length. The adjustability in length is achieved by a threaded connection 22*a* between two parts of the rod 22.

The device 20 according to the present invention can either be loosely inserted between the lowered car roof portion 4.1 and the car inner wall (3.1, 3.2) or fastened to the car roof portion 4.1. In the first case it does not require any special fastening means for the fastening of the device 20 to the car roof portion 4.1. The device 20 can in that case be arranged between an edge or a corner of the car roof portion 4.1 and a car inner wall and be clamped in place by actuation of a mechanism (for example the toggle lever clamping device 27).

The mechanical device 20 can, however, also be fixedly connected with the lowered car roof portion 4.1 as shown in FIGS. 2A and 2B. This is preferably carried out in that the corresponding mechanical device 20 is fastened to the lowerable car roof portion 4.1 by the fastening means 26, for example by screws. In that case it does not matter whether at the beginning of the service operations the mechanical device 20 is mounted each time and removed again at the end or whether the device also remains fastened to the unlowered car roof portion 4.1 during normal elevator operation.

One or more of the mechanical devices 20 can be used. For example, the lowered car roof portion 4.1 can be pressed against one of the inner walls of the elevator car 3 and clamped in place with the help of only one or two of the mechanical devices 20 (see, for example, FIG. 2B). The lowered car roof portion 4.1 can, however, also be centered and clamped by several of the mechanical devices 20 in the center of the interior space 5 of the elevator car 3. The movable ends of the mechanical devices 20 are in that case preferably pressed against the corner regions of the elevator car walls.

Figure 2C:
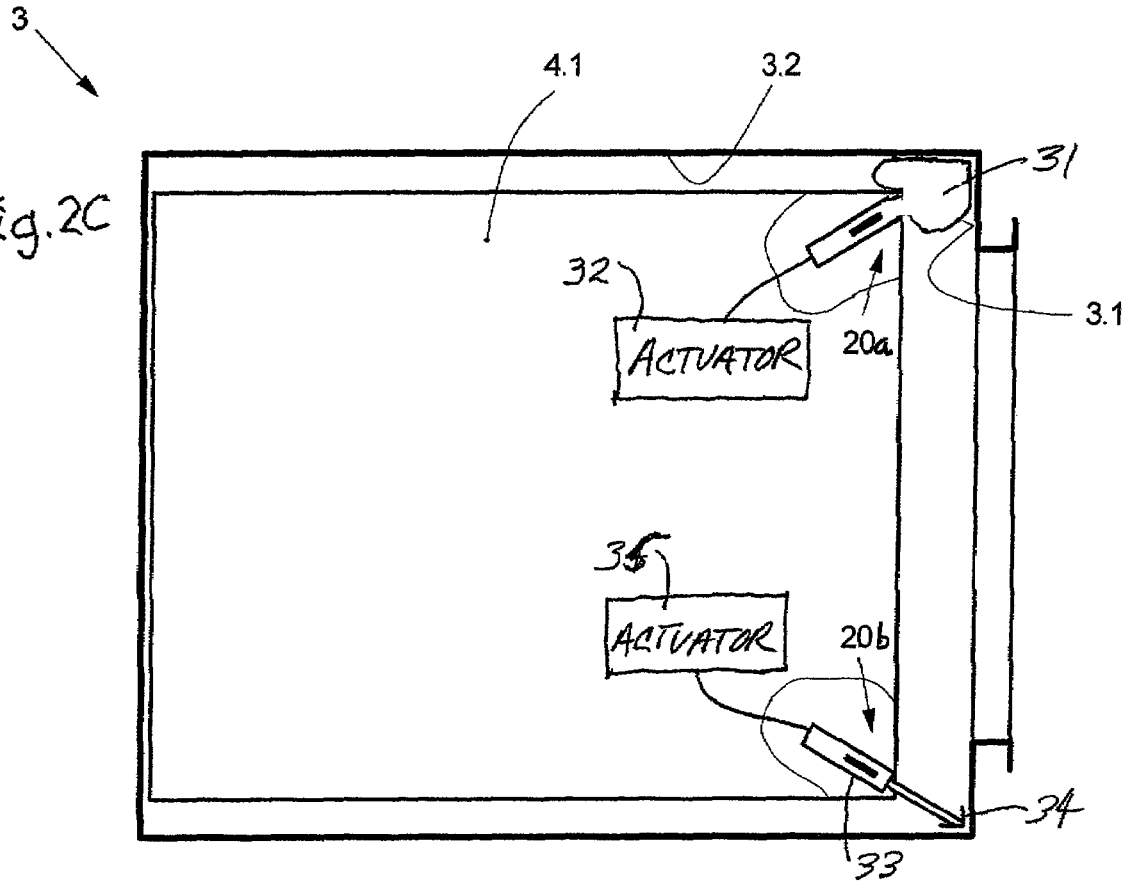
FIG. 2C is a view similar to FIG. 2B showing two alternate embodiments of the device for mechanical stabilization according to the present invention.

A further possibility for stabilization of the lowered car roof portion 4.1 consists in clamping, at at least one position, a cushion between the lowered car roof portion 4.1 and the car walls 3.1, 3.2 of the elevator car 3 by selective volume enlargement. An alternate embodiment mechanical device 20*a* is shown in FIG. 2C and includes an inflatable cushion 31. The cushion 31 is advantageously arranged in the region of a corner of the lowered car roof portion 4.1. Depending on the respective spacing between the lowered car roof portion 4.1 and the car walls 3.1, 3.2 of the elevator car 3 the shape and size of the cushion can be selected or adapted in different manner.

The volume enlargement results through the introduction of a gaseous or liquid filling material into the cushion 31 from a connected actuator 32. The filling material can be introduced with or without pressure into the cushion 31. The volume of the cushion 31 is in that case enlarged until the lowered car roof portion 4.1 is stabilized in the interior space 5 of the elevator car 3 by contact of the cushion 31 with the lowered car roof portion 4.1 on one side and the car walls 3.1, 3.2 of the elevator car 3 on the other side.

In that case use can be made of one or more of the cushions 31. Thus, for example, the lowered car roof portion 4.1 can be pressed and clamped against one of the inner walls of the elevator car 3 with the help of one or two of the cushions 31 in a manner similar to that shown in FIG. 2B. The lowered car roof portion 4.1 can, however, also be centered by three or four cushions in the interior space 5 of the elevator car 3. The cushions 31 can in that case be tightened not only against corner regions of the elevator car walls, but also against the surfaces of the elevator car walls.

The damping and spring characteristics can be influenced by the filling material of the cushion 31 and also by the material property of the cushion. A number of filling materials such as, for example, air, oil, water, gels, etc., is usable.

The cushion is preferably filled by activation of a pump (actuator 32) actuated by the service engineer 8 by hand or by foot. The filling can obviously also take place by activation of an electrically driven pump.

It does not matter whether at the beginning of the service operations the cushion 31 and/or the pump 32 is mounted each time and removed again at the end or whether during normal elevator operation it also remains fixed, in unfilled, passive form, to the unlowered car roof portion 4.1. Instead of the cushions 31, use can also be made of a second alternative embodiment mechanical device 20*b* having a pneumatic cylinder 33, which is mounted on the car roof portion 4.1, with piston and piston rod as the stabilizing device as shown in FIG. 2C. In that case a piston rod head 34, which forms a movable end of the device and which is soft and capable of sliding, is pressed, on each occasion by the stroke of the piston and the piston rod, against a car inner wall or into a corner formed by two car inner walls. The cylinder 33 is actuated by a connected actuator 35.

According to the present invention stabilization can also be achieved by a combination of the described means.

Another embodiment (not shown) in which, for example, several of the mechanical devices 20 are simultaneously actuated by steel cables or a lever system, whereby the lowered car roof portion 4.1 is tightened and stabilized in several directions relative to the car inner walls, is particularly convenient in operation. An embodiment in which the service engineer 8 standing on the lowered car portion 4.1 can actuate the steel cables or the lever system by foot or hand in order to achieve the mechanical stabilization is advantageous. After conclusion of the work on the lowered car roof portion 4.1 the mechanical stabilization can be removed by way of a further actuation before the car roof portion 4.1 is raised again.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator car comprising:

a lowerable car roof portion movable between a raised position and a lowered position;

at least one car inner wall; and at least one stabilizing device fastened to said car roof portion for stabilizing said car roof portion in the lowered position against movements in a horizontal plane by pressing a movable portion of said stabilizing device against said at least one car inner wall.

2. The elevator car according to claim 1 wherein said at least one stabilizing device includes a toggle lever clamping device by which said at least one stabilizing device is fastened to said car roof portion and for pressing a movable end of said at least one stabilizing device against said at least one car inner wall.

3. The elevator car according to claim 2 wherein said at least one stabilizing device includes a spring element acting on said toggle lever clamping device to prevent exceeding a permissible clamping force between said movable end and said at least one car inner wail.

4. The elevator car according to claim 1 wherein an end of said at least one stabilizing device facing said at least one car inner wall is provided with a soft non-scratching coating.

5. The elevator car according to claim 1 including a fastening means at an end of said at least one stabilizing device for fastening said at least one stabilizing device to said car roof portion.

6. The elevator car according to claim 1 wherein said at least one stabilizing device is adjustable in length.

7. A device for stabilization of a lowerable car roof portion of an elevator car comprising: a toggle lever clamping device fastened to the car roof portion in a lowered position and being connected to a movable end for pressing said movable end against a car inner wall to stabilize the car roof portion.

8. An elevator car having a lowerable car roof portion comprising:

a car roof portion movable between a raised position and a lowered position; and at least a pair of stabilizing devices fastened to said car roof portion in the lowered position and being actuatable into pressing engagement with inner walls of the elevator car for stabilizing said car roof portion against movements in a horizontal plane.

* * * * *